US006575216B2

(12) United States Patent
Yang

(10) Patent No.: US 6,575,216 B2
(45) Date of Patent: Jun. 10, 2003

(54) LABELING MACHINE CAPABLE OF DETECTION OF DEFECTIVE PRODUCTS AND REMOVAL OF THE DEFECTIVE PRODUCTS AT A TAKE-OUT END OF A CONVEYING UNIT THEREOF

(76) Inventor: Sheng-Hui Yang, No. 2, Lane 64, Tung-Kuang-Yuan Rd., Tung Dist., Taichung City (TW)

( * ) Notice: Subject to any disclaimer, the term of this patent is extended or adjusted under 35 U.S.C. 154(b) by 59 days.

(21) Appl. No.: 09/966,609

(22) Filed: Sep. 28, 2001

(65) Prior Publication Data

US 2002/0040767 A1 Apr. 11, 2002

(30) Foreign Application Priority Data

Oct. 5, 2000 (TW) ..... 89217298 U

(51) Int. Cl.[7] ..... G05G 23/00

(52) U.S. Cl. ..... 156/351; 156/361; 156/362; 156/378; 156/387; 156/566

(58) Field of Search ..... 156/351, 352, 156/360, 361, 362, 363, 367, 378, 387, 449, 451, 455, 453, 456, 566, 567, DIG. 44, DIG. 45, DIG. 46, DIG. 47

(56) References Cited

U.S. PATENT DOCUMENTS 4,239,570 A 12/1980 Kerwin
4,294,644 A 10/1981 Anderson
4,321,103 A * 3/1982 Lindstrom et al. ..... 156/351
4,585,506 A 4/1986 Matsuguchi
4,620,887 A 11/1986 Kontz et al.
4,647,333 A 3/1987 Voltmer et al.
RE33,579 E 4/1991 Voltmer et al.
5,256,239 A 10/1993 Voltmer et al.
5,269,864 A 12/1993 Otruba
5,427,029 A 6/1995 Dumke
5,730,816 A 3/1998 Murphy
5,785,798 A 7/1998 Horsman et al.
5,798,020 A 8/1998 Coughlin et al.
5,810,955 A 9/1998 Seifert et al.

* cited by examiner

*Primary Examiner*—Richard Crispino
*Assistant Examiner*—George R. Koch, III
(74) *Attorney, Agent, or Firm*—Harness, Dickey & Pierce, P.L.C.

(57) ABSTRACT

In a labeling machine, a bar code sensor, a batch information sensor and a label sensor are coupled electrically to a controller, and are disposed along an advancing route of a label reel. When any of these sensors detects an error in one of the labels or the absence of a label on the reel, the controller activates a container removal unit to remove the container with the defective label or with no label at a take-out end of a container conveying unit.

17 Claims, 5 Drawing Sheets

LABELING MACHINE CAPABLE OF DETECTION OF DEFECTIVE PRODUCTS AND REMOVAL OF THE DEFECTIVE PRODUCTS AT A TAKE-OUT END OF A CONVEYING UNIT THEREOF

CROSS-REFERENCE TO RELATED APPLICATION

This application claims priority of Taiwan Patent Application No. 89217298, filed on Oct. 5, 2000.

BACKGROUND OF THE INVENTION

1. Field of the Invention

The invention relates to a labeling machine, more particularly to a labeling machine that is capable of detection of defective products and automatic removal of the defective products at a take-out end of a conveying unit thereof.

2. Description of the Related Art

Commodities, such as beverage bottles, drug bottles, containers, and packaging boxes, are generally provided with a label to classify products, to indicate usage and other information, to display the trademark or logo of the manufacturer, etc. With the recent advancement in automation, automated attachment of labels to such commodities has taken the place of manual label attachment, and has become quite popular in the industry.

In a conventional labeling machine, a reel of labels is arranged on a reel supporting plate. A leading edge of the reel is drawn via a driving device to a label applicator plate where the labels are applied to containers being advanced by a container conveying unit. However, the conventional labeling machine cannot effectively overcome problems associated with the detection of defective containers that are not properly labeled, and the removal of the same.

In a label reel, a series of adhesive-backed labels are adhered to a waxed backing paper strip. Referring to FIG. 1, under normal conditions, the labels should be spaced apart from each other by a uniform clearance, and there should not be any missing label. Moreover, the bar codes or batch information on the labels should be correctly printed. The conventional labeling machine, as a matter of fact, is unable to automatically detect containers that are not properly labeled, and has to rely upon manual inspection for removing the defective containers. Although there is available image comparison equipment to detect containers attached with defective labels, it is very expensive, complicated in construction, and operable only by skilled personnel.

The applicant has made various improvements on the labeling machine and has filed applications therefor in the United States. In co-pending U.S. Ser. No. 09/767,781, the applicant discloses a label applying unit for a labeling machine and suitable for applying labels of different lengths in automated operations. In co-pending U.S. Ser. No. 09/767,783, the applicant describes a labeling machine that is capable of preventing erroneous attachment of labels to containers. In co-pending U.S. Ser. No. 09/767,780, the applicant teaches a label-sensing device for a labeling machine that is adjustable to suit the actual ambient light condition. In co-pending U.S. Ser. No. 09/768,100, the applicant discloses a labeling machine with a container spacer device that can appropriately adjust a spacing between adjacent containers during a label attachment operation. In co-pending U.S. Ser. No. 09/768,114, the applicant teaches a labeling machine that is capable of attaching labels precisely to different sizes of containers. The contents of the aforesaid patent applications are incorporated herein by reference.

SUMMARY OF THE INVENTION

Therefore, the main object of the present invention is to provide a labeling machine that is capable of automatic detection of defective products and removal of the same at a take-out end of a conveying unit.

Accordingly, the labeling machine of the present invention includes:

- a motor-driven container conveying unit having a feed-in end and a take-out end, the conveying unit being adapted to convey a plurality of containers from the feed-in end to the take-out end;
- a label applying unit disposed adjacent to the conveying unit between the feed-in and take-out ends, and operable so as to be adapted to attach labels on the containers being conveyed by the conveying unit, the label applying unit including
  - a reel support plate adapted to support a label reel thereon, the label reel including a backing paper strip and a plurality of the labels releasably and successively adhered on the backing paper strip, each of the labels having a bar code printed thereon,
  - a label applicator plate adapted to release the labels from the backing paper strip for application to the containers being conveyed by the conveying unit, and
  - a motor-driven feed roller unit disposed between the reel support plate and the label applicator plate and operable so as to feed one end of the label reel on the reel support plate to the label applicator plate;
- a container sensor disposed anterior to the label applicator plate relative to an advancing route of the label reel, and adapted to generate a container detect signal upon detection of one of the containers being conveyed by the conveying unit;
- a controller coupled electrically to the feed roller unit and the container sensor, the controller activating the feed roller unit in accordance with the container detect signal from the container sensor so as to advance the label reel for attaching one of the labels onto said one of the containers detected by the container sensor and being conveyed by the conveying unit;
- a container removal unit coupled electrically to the controller, disposed posterior to the label applicator plate relative to the advancing route of the label reel, and operable so as to remove one of the containers at the take-out end of the conveying unit;
- a bar code sensor coupled electrically to the controller, disposed adjacent to the advancing route of the label reel between the reel support plate and the label applicator plate, and adapted to sense the bar codes on the labels of the label reel and to generate corresponding bar code data;
- the controller comparing the bar code data from the bar code sensor with predetermined bar code data and, upon detection by the controller that the bar code data of one of the labels does not match the predetermined bar code data, the controller timely activating the container removal unit so as to remove one of the containers at the take-out end that was attached with said one of the labels whose bar code data does not match the predetermined bar code data;

a label sensor coupled electrically to the controller and disposed adjacent to the advancing route of the label reel between the reel support plate and the label applicator plate, the label sensor generating a first signal upon detection of a part of the backing paper strip having one of the labels adhered thereon, and further generating a second signal upon detection of another part of the backing paper strip having none of the labels adhered thereon;

wherein upon detection by the controller that the duration of the second signal from the label sensor has exceeded a predetermined threshold, indicating that a portion of the label reel has none of the labels adhered thereon, the controller timely activating the container removal unit so as to remove one of the containers at the take-out end that was not attached with any one of the labels;

a printing unit disposed adjacent to the advancing route of the label reel between the reel support plate and the label applicator plate, and adapted to print batch information on the labels of the label reel; and a batch information sensor coupled electrically to the controller, disposed adjacent to the advancing route of the label reel between the printing unit and the label applicator plate, and adapted to sense the batch information that was printed on the labels of the label reel and to generate corresponding batch information data;

the controller comparing the batch information data from the batch information sensor with predetermined batch information data and, upon detection by the controller that the batch information data of one of the labels does not match the predetermined batch information data, the controller timely activating the container removal unit so as to remove one of the containers at the take-out end that was attached with said one of the labels whose batch information data does not match the predetermined batch information data.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
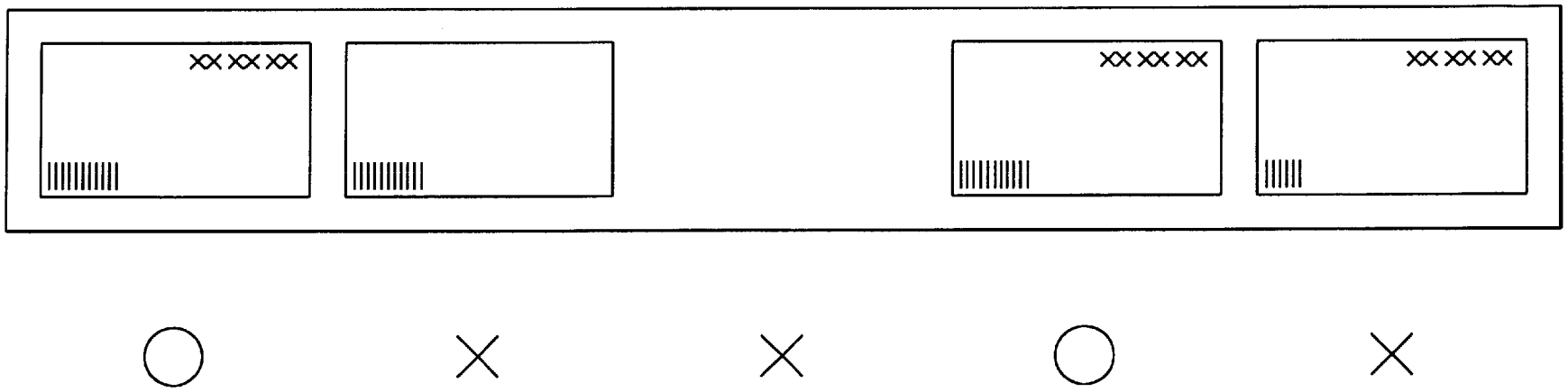
FIG. 1 PRIOR ART
FIG. 1 is a schematic view illustrating defective labels and absence of a label on a portion of a label reel.
Figure 2:
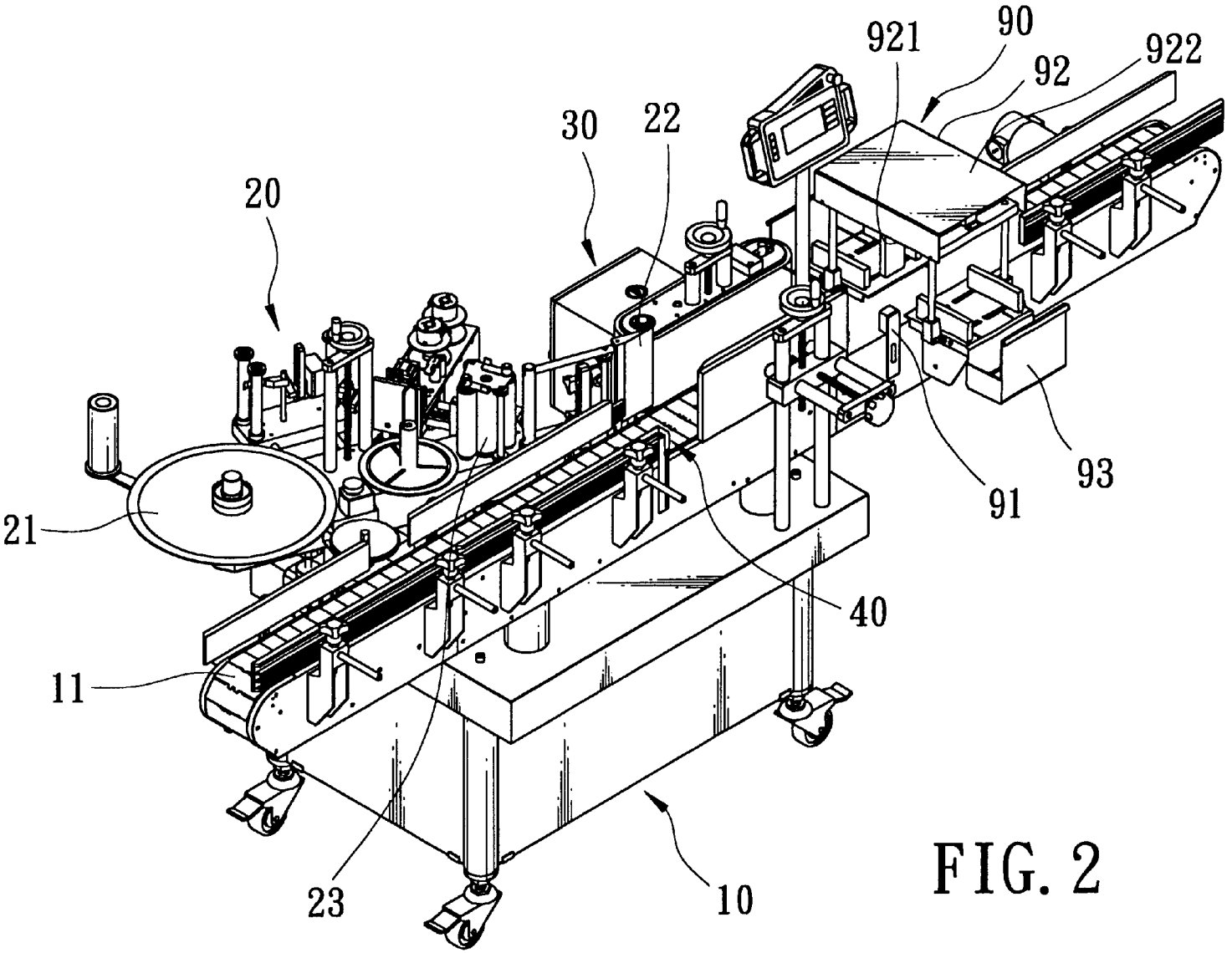
FIG. 2 is a perspective view of the preferred embodiment of a labeling machine according to the present invention.
Figure 3:
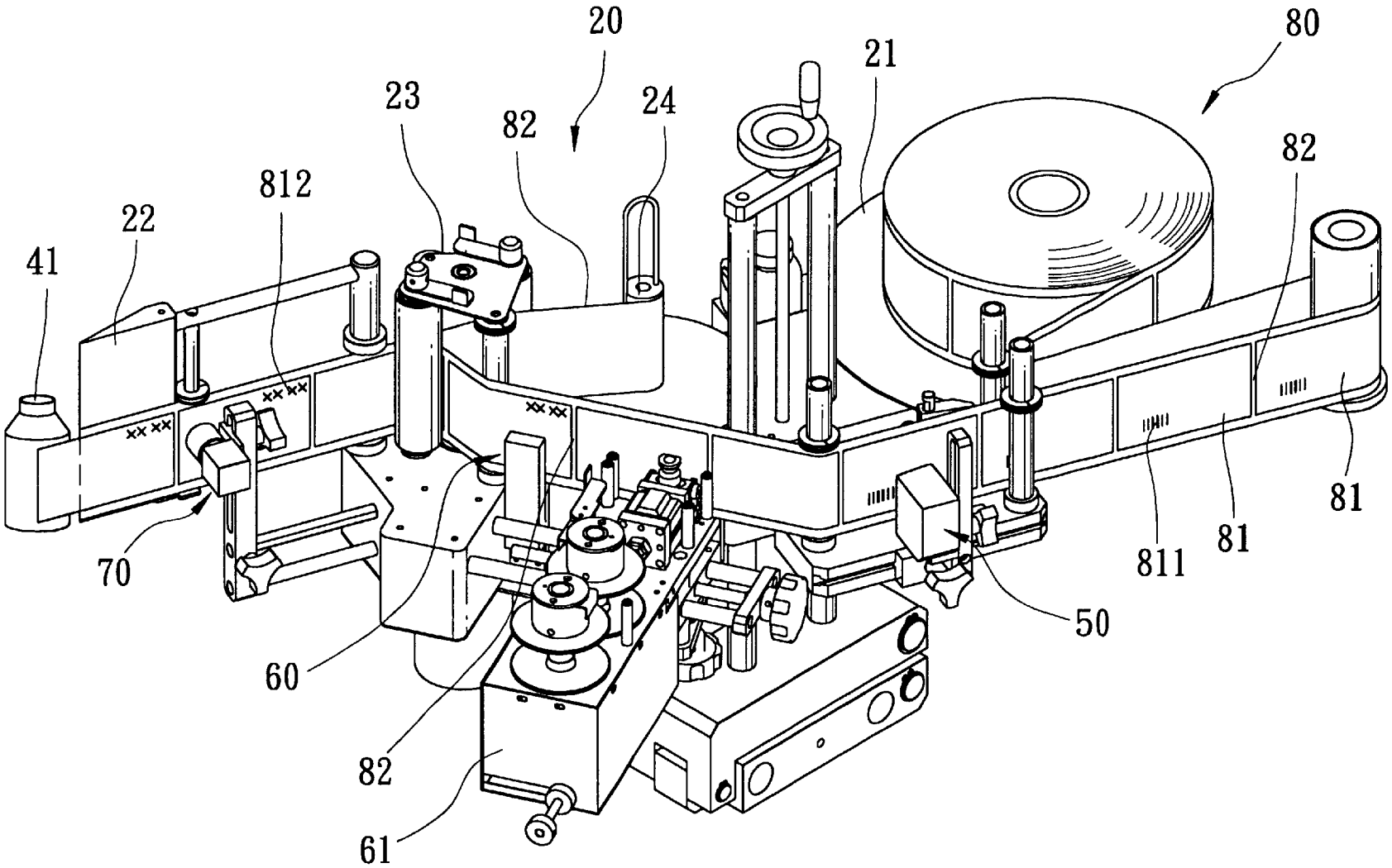
FIG. 3 is a perspective view of the preferred embodiment in part.

Referring to FIGS. 2 and 3, the preferred embodiment of a labeling machine according to the present invention is shown to include a base 10, and a motor driven container conveying unit 11, a label applying unit 20, and a controller 30 disposed on top of the base 10. The labeling machine further includes a container sensor 40, a container removal unit 90, a bar code sensor 50, a label sensor 60, a printing unit 61, and a batch information sensor 70. Each of the bar code sensor 50, the label sensor 60, and the batch information sensor 70 are spaced apart from a label applicator plate 22 of the label applying unit 20 at predetermined distances that are in units of length of the labels 81. As the conveying unit 11 and the label applying unit 20 are known in the art, and since the feature of the invention does not reside in the particular configuration of the same, a detailed description thereof will not be provided herein for the sake of brevity.

The conveying unit 11 has a feed-in end and a take-out end, and is adapted to convey a plurality of containers 41 from the feed-in end to the take-out end.

The label applying unit 20 is disposed adjacent to the conveying unit 11 between the feed-in and take-out ends, and is operable so as to be adapted to attach labels 81 on the containers 41 being conveyed by the conveying unit 11. The label applying unit includes a reel support plate 21, the label applicator plate 22, and a motor-driven feed roller unit 23. The reel support plate 21 is adapted to support a label reel 80 thereon. The label reel 80 includes a backing paper strip 82 and a plurality of the labels 81 releasably and successively adhered on the backing paper strip 82. Each of the labels 81 has a bar code 811 printed thereon. The label applicator plate 22 is adapted to release the labels 81 from the backing paper strip 82 for application to the containers 41 being conveyed by the conveying unit 11. The feed roller unit 23 is disposed between the reel support plate 21 and the label applicator plate 22, and is operable so as to feed one end of the label reel 80 on the reel support plate 21 to the label applicator plate 22. A backing paper collector 24 collects the used-up portion of the label reel 80 in a conventional manner.

The container sensor 40 is disposed anterior to the label applicator plate 22 relative to an advancing route of the label reel 80, and is adapted to generate a container detect signal upon detection of one of the containers 41 being conveyed by the conveying unit 11.

The controller 30 is coupled electrically to the feed roller unit 23 and the container sensor 40, and activates the feed roller unit 23 in accordance with the container detect signal from the container sensor 40 so as to advance the label reel 80 for attaching one of the labels 81 onto said one of the containers 41 which is detected by the container sensor 40 and which is being conveyed by the conveying unit 11.

The container removal unit 90 is coupled electrically to the controller 30, is disposed posterior to the label applicator plate 22 relative to the advancing route of the label reel 80, and is operable so as to remove one of the containers 41 at the take-out end of the conveying unit 11.

The bar code sensor 50 is coupled electrically to the controller 30, is disposed adjacent to the advancing route of the label reel 80 between the reel support plate 21 and the label applicator plate 22, and is adapted to sense the bar codes 811 on the labels 81 of the label reel 80 and to generate corresponding bar code data.

The controller 30 compares the bar code data from the bar code sensor 50 with predetermined bar code data stored therein. Upon detection by the controller 30 that the bar code data of one of the labels 81 does not match the predetermined bar code data, the controller 30 timely activates the container removal unit 90 so as to remove one of the containers 41 at the take-out end that was attached with said one of the labels 81 whose bar code data does not match the predetermined bar code data.

The label sensor 60 is coupled electrically to the controller 30 and is disposed adjacent to the advancing route of the label reel 80 between the reel support plate 21 and the label applicator plate 22. The label sensor 60 generates a first signal upon detection of a part of the backing paper strip 82 having one of the labels 81 adhered thereon, and further generates a second signal upon detection of another part of the backing paper strip 82 having none of the labels 81 adhered thereon.

Upon detection by the controller 30 that the duration of the second signal from the label sensor 60 has exceeded a predetermined threshold, indicating that a portion of the label reel 80 has none of the labels 81 adhered thereon, the controller 30 timely activates the container removal unit 90 so as to remove one of the containers 41 at the take-out end that was not attached with any one of the labels 81.

The printing unit 61 is disposed adjacent to the advancing route of the label reel 80 between the reel support plate 21 and the label applicator plate 22, and is adapted to print batch information 812 on the labels 81 of the label reel 80.

The batch information sensor 70 is coupled electrically to the controller 30, is disposed adjacent to the advancing route of the label reel 80 between the printing unit 61 and the label applicator plate 22, and is adapted to sense the batch information 812 that was printed on the labels 81 of the label reel 80 and to generate corresponding batch information data.

The controller 30 compares the batch information data from the batch information sensor 70 with predetermined batch information data stored therein. Upon detection by the controller 30 that the batch information data of one of the labels 81 does not match the predetermined batch information data, the controller 30 timely activates the container removal unit 90 so as to remove one of the containers 41 at the take-out end that was attached with said one of the labels 81 whose batch information data does not match the predetermined batch information data.

The container removal unit 90 includes a counter 91 for generating a count output corresponding to each of the containers 41 processed by the label applying unit 20, and a push unit 92 operable so as to push said one of the containers 41 for removal at the take-out end of the conveying unit 11. The push unit 92 includes a mounting seat 922 mounted above the conveying unit 11 and disposed anterior to the counter 91 relative to the advancing route of the label reel 80, a pressure cylinder (not visible) mounted to a bottom surface of the mounting seat 922, and a push plate 921 connected to the pressure cylinder and extending above the conveying unit 11. The pressure cylinder drives pushing operation of the push plate 921.

The labeling machine of this invention further includes a container collector 93 for collecting each of the containers 41 that was removed by the container removal unit 90 at the take-out end of the conveying unit 11. In this embodiment, two container collectors 93, which are in the form of troughs, are disposed on opposite sides of the mounting seat 922.

Figure 4:
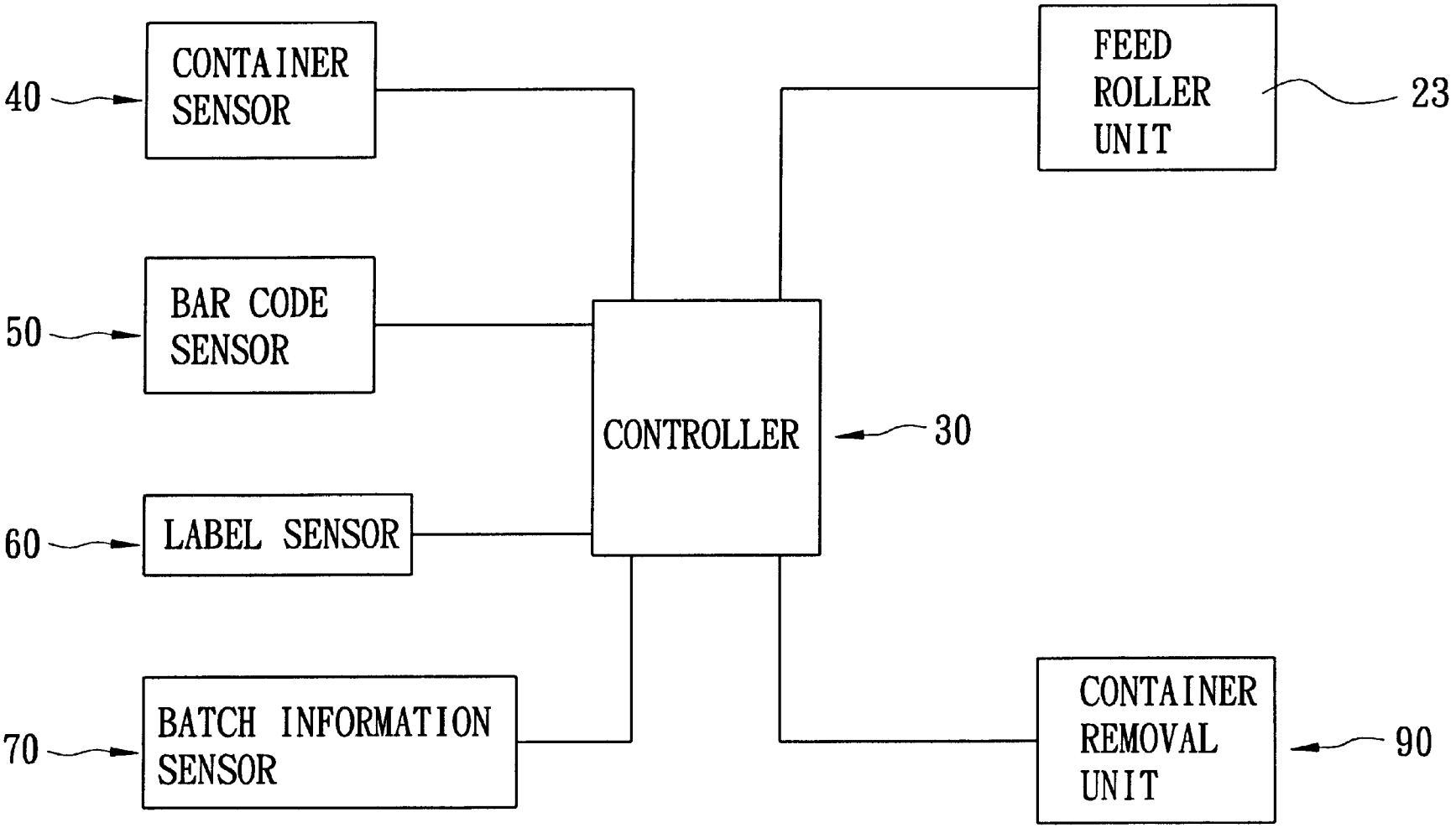
FIG. 4 is a block diagram illustrating the relationship among a controller, sensors and relevant components.
Figure 5:
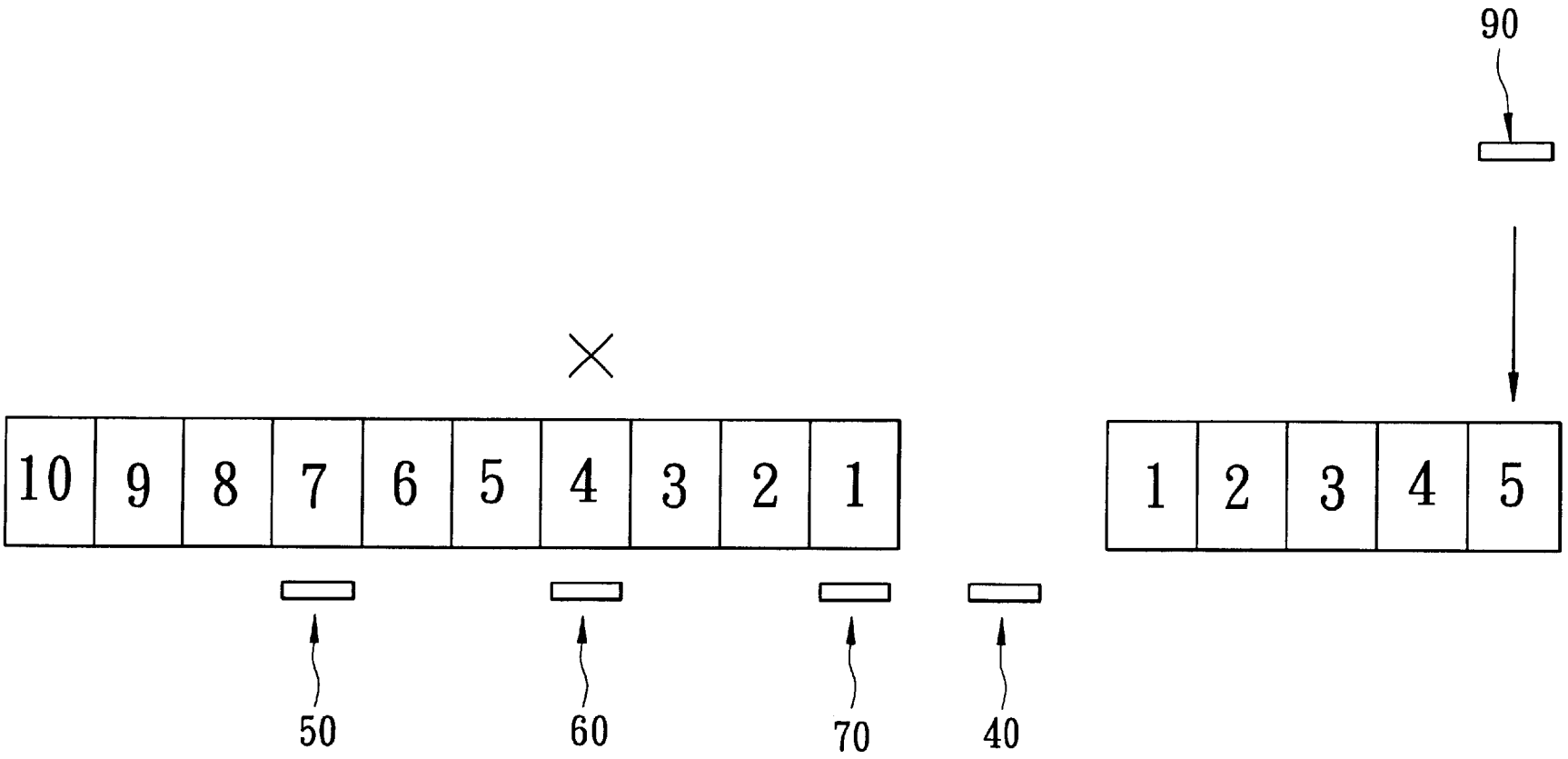
FIG. 5 is a schematic view illustrating a container removal operation of the preferred embodiment.

The operation of the present invention will now be described with further reference to FIGS. 3 to 5.

During an initialization operation, the controller 30 first calculates the length of the labels 81. For the detection of the length of the labels 81, please refer to the abovementioned co-pending U.S. Ser. No. 09/768,114, the disclosure of which is incorporated herein by reference. Based on the detected length of the label 81, and under the condition that the bar code sensor 50, the label sensor 60, and the batch information sensor 70 are located at fixed positions, the distance between the label applicator plate 22 and the respective one of the bar code sensor 50, the label sensor 60, and the batch information sensor 70 in units of length of the label 81 can be assessed.

For purposes of exemplification, it is supposed that the batch information sensor 70 corresponds to a second label position from the label applicator plate 22, the label sensor 60 corresponds to a fourth label position from the label applicator plate 22, and the bar code sensor 50 corresponds to a seventh label position from the label applicator plate 22. If any of the batch information sensor 70, the label sensor 60, and the bar code sensor 50 detects an error, for instance, a wrong bar code, a missing label, wrong batch information, etc., the controller 30 will write an error signal (A) into a corresponding address field. In this embodiment, it is assumed that when the label 81 at the fourth label position is missing, the controller 30 will, after receiving the second signal from the label sensor 60, write an error message into the fourth address field and activate both the container sensor 40 and the container removal unit 90. As the container sensor 40 generates a container detect signal upon detection of one of the containers 41, when four container detect signals are generated since detection of the error, the container sensor 40 will face the container 41 that will not have any label 81 attached thereto. The container sensor 40 is spaced apart from the container removal unit 90 at a distance in units of the number of containers 41. Assuming that the container sensor 40 is spaced apart from the container removal unit 90 by five containers 41, the push plate 921 of the push unit 92 of the container removal unit 90 will, on the count of the ninth container 41 since the detection of the error, push the container 41 that is without any label thereon sidewise into one of the container collectors 93 on one side of the mounting seat 922.

In regard to the calculation of the number of containers 41 conveyed between the container sensor 40 and the container removal unit 90, when the labeling machine is activated and the containers 41 are conveyed one by one past the container sensor 40, the controller 30 will be aware of the number of containers 41 passing by the container sensor 40 and will deduct therefrom the number of containers 41 conveyed past the counter 91 of the container removal unit 90. Therefore, regardless of whether the labeling machine is operating or in a paused condition, the number of containers 41 conveyed by the conveying unit 11 is stored in the controller 30. To illustrate, if it is detected that a total of seven containers 41 have been conveyed from the container sensor 40 to the container removal unit 90, and that the counter 91 has detected that two of the containers 41 have been processed by the label applying unit 20, it means that the container sensor 40 is five containers 41 away from the container removal unit 90. Therefore, in the embodiment, when the controller 30 writes into the fourth address field that the label 81 at the fourth position is missing and generates a corresponding signal to the container sensor 40, the push plate 921 of the push unit 92 of the container removal unit 90 will be activated to remove the ninth one of the containers 41 counted from the detection of the error, thereby ensuring accuracy of container removal.

In view of the aforesaid, it is apparent that the present invention can ensure removal of defective products in a cost-effective manner for automated operation to solve the problems associated with the conventional labeling machine.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A labeling machine comprising:

a motor-driven container conveying unit having a feed-in end and a take-out end, said conveying unit being adapted to convey a plurality of containers from said feed-in end to said take-out end;

a label applying unit disposed adjacent to said conveying unit between said feed-in and take-out ends, and operable so as to be adapted to attach labels on the containers being conveyed by said conveying unit, said label applying unit including a reel support plate adapted to support a label reel thereon, the label reel including a backing paper strip and a plurality of the labels releasably and successively adhered on the backing paper strip, each of the labels having a bar code printed thereon, a label applicator plate adapted to release the labels from the backing paper strip for application to the containers being conveyed by said conveying unit, and a motor-driven feed roller unit disposed between said reel support plate and said label applicator plate and operable so as to feed one end of the label reel on said reel support plate to said label applicator plate;

a container sensor disposed anterior to said label applicator plate relative to an advancing route of the label reel, and adapted to generate a container detect signal upon detection of one of the containers being conveyed by said conveying unit;

a controller coupled electrically to said feed roller unit and said container sensor, said controller activating said feed roller unit in accordance with the container detect signal from said container sensor so as to advance the label reel for attaching one of the labels onto said one of the containers detected by said container sensor and being conveyed by said conveying unit;

a container removal unit coupled electrically to said controller, disposed posterior to said label applicator plate relative to the advancing route of the label reel, and operable so as to remove one of the containers at said take-out end of said conveying unit; and a bar code sensor coupled electrically to said controller, disposed adjacent to the advancing route of the label reel between said reel support plate and said label applicator plate, and adapted to sense the bar codes on the labels of the label reel and to generate corresponding bar code data;

said controller comparing the bar code data from said bar code sensor with predetermined bar code data and, upon detection by said controller that the bar code data of one of the labels does not match the predetermined bar code data, said controller timely activating said container removal unit so as to remove one of the containers at said take-out end that was attached with said one of the labels whose bar code data does not match the predetermined bar code data.

2. The labeling machine of claim 1, wherein said container removal unit includes:

a counter for generating a count output corresponding to each of the containers processed by said label applying unit; and a push unit operable so as to push said one of the containers for removal at said take-out end of said conveying unit.

3. The labeling machine of claim 2, wherein said push unit includes a push plate and a pressure cylinder for driving pushing operation of said push plate.

4. The labeling machine of claim 1, further comprising a container collector for collecting said one of the containers that was removed by said container removal unit at said take-out end of said conveying unit.

5. A labeling machine comprising:

a motor-driven container conveying unit having a feed-in end and a take-out end, said conveying unit being adapted to convey a plurality of containers from said feed-in end to said take-out end;

a label applying unit disposed adjacent to said conveying unit between said feed-in and take-out ends, and operable so as to be adapted to attach labels on the containers being conveyed by said conveying unit, said label applying unit including a reel support plate adapted to support a label reel thereon, the label reel including a backing paper strip and a plurality of the labels releasably and successively adhered on the backing paper strip, a label applicator plate adapted to release the labels from the backing paper strip for application to the containers being conveyed by said conveying unit, and a motor-driven feed roller unit disposed between said reel support plate and said label applicator plate and operable so as to feed one end of the label reel on said reel support plate to said label applicator plate;

a container sensor disposed anterior to said label applicator plate relative to an advancing route of the label reel, and adapted to generate a container detect signal upon detection of one of the containers being conveyed by said conveying unit;

a controller coupled electrically to said feed roller unit and said container sensor, said controller activating said feed roller unit in accordance with the container detect signal from said container sensor so as to advance the label reel for attaching one of the labels onto said one of the containers detected by said container sensor and being conveyed by said conveying unit;

a container removal unit coupled electrically to said controller, disposed posterior to said label applicator plate relative to the advancing route of the label reel, and operable so as to remove one of the containers at said take-out end of said conveying unit; and a label sensor coupled electrically to said controller and disposed adjacent to the advancing route of the label reel between said reel support plate and said label applicator plate, said label sensor generating a first signal upon detection of a part of the backing paper strip having one of the labels adhered thereon, and further generating a second signal upon detection of another part of the backing paper strip having none of the labels adhered thereon;

wherein upon detection by said controller that the duration of the second signal from said label sensor has exceeded a predetermined threshold, indicating that a portion of the label reel has none of the labels adhered thereon, said controller timely activating said container removal unit so as to remove one of the containers at said take-out end that was not attached with any one of the labels.

6. The labeling machine of claim 5, wherein said container removal unit includes:

a counter for generating a count output corresponding to each of the containers processed by said label applying unit; and a push unit operable so as to push said one of the containers for removal at said take-out end of said conveying unit.

7. The labeling machine of claim 6, wherein said push unit includes a push plate and a pressure cylinder for driving pushing operation of said push plate.

8. The labeling machine of claim 5, further comprising a container collector for collecting said one of the containers that was removed by said container removal unit at said take-out end of said conveying unit.

9. A labeling machine comprising:

a motor-driven container conveying unit having a feed-in end and a take-out end, said conveying unit being adapted to convey a plurality of containers from said feed-in end to said take-out end;

a label applying unit disposed adjacent to said conveying unit between said feed-in and take-out ends, and operable so as to be adapted to attach labels on the containers being conveyed by said conveying unit, said label applying unit including a reel support plate adapted to support a label reel thereon, the label reel including a backing paper strip and a plurality of the labels releasably and successively adhered on the backing paper strip, a label applicator plate adapted to release the labels from the backing paper strip for application to the containers being conveyed by said conveying unit, and a motor-driven feed roller unit disposed between said reel support plate and said label applicator plate and operable so as to feed one end of the label reel on said reel support plate to said label applicator plate;

a container sensor disposed anterior to said label applicator plate relative to an advancing route of the label reel, and adapted to generate a container detect signal upon detection of one of the containers being conveyed by said conveying unit;

a controller coupled electrically to said feed roller unit and said container sensor, said controller activating said feed roller unit in accordance with the container detect signal from said container sensor so as to advance the label reel for attaching one of the labels onto said one of the containers detected by said container sensor and being conveyed by said conveying unit;

a printing unit disposed adjacent to the advancing route of the label reel between said reel support plate and said label applicator plate, and adapted to print batch information on the labels of the label reel; and a batch information sensor coupled electrically to said controller, disposed adjacent to the advancing route of the label reel between said printing unit and said label applicator plate, and adapted to sense the batch information that was printed on the labels of the label reel and to generate corresponding batch information data;

said controller comparing the batch information data from said batch information sensor with predetermined batch information data and, upon detection by said controller that the batch information data of one of the labels does not match the predetermined batch information data, said controller timely activating said container removal unit so as to remove one of the containers at said take-out end that was attached with said one of the labels whose batch information data does not match the predetermined batch information data.

10. The labeling machine of claim 9, wherein said container removal unit includes:

a counter for generating a count output corresponding to each of the containers processed by said label applying unit; and a push unit operable so as to push said one of the containers for removal at said take-out end of said conveying unit.

11. The labeling machine of claim 10, wherein said push unit includes a push plate and a pressure cylinder for driving pushing operation of said push plate.

12. The labeling machine of claim 9, further comprising a container collector for collecting said one of the containers that was removed by said container removal unit at said take-out end of said conveying unit.

13. A labeling machine comprising:

a motor-driven container conveying unit having a feed-in end and a take-out end, said conveying unit being adapted to convey a plurality of containers from said feed-in end to said take-out end;

a label applying unit disposed adjacent to said conveying unit between said feed-in and take-out ends, and operable so as to be adapted to attach labels on the containers being conveyed by said conveying unit, said label applying unit including a reel support plate adapted to support a label reel thereon, the label reel including a backing paper strip and a plurality of the labels releasably and successively adhered on the backing paper strip, each of the labels having a bar code printed thereon, a label applicator plate adapted to release the labels from the backing paper strip for application to the containers being conveyed by said conveying unit, and a motor-driven feed roller unit disposed between said reel support plate and said label applicator plate and operable so as to feed one end of the label reel on said reel support plate to said label applicator plate;

a container sensor disposed anterior to said label applicator plate relative to an advancing route of the label reel, and adapted to generate a container detect signal upon detection of one of the containers being conveyed by said conveying unit;

a controller coupled electrically to said feed roller unit and said container sensor, said controller activating said feed roller unit in accordance with the container detect signal from said container sensor so as to advance the label reel for attaching one of the labels onto said one of the containers detected by said container sensor and being conveyed by said conveying unit;

a container removal unit coupled electrically to said controller, disposed posterior to said label applicator plate relative to the advancing route of the label reel, and operable so as to remove one of the containers at said take-out end of said conveying unit;

a bar code sensor coupled electrically to said controller, disposed adjacent to the advancing route of the label reel between said reel support plate and said label applicator plate, and adapted to sense the bar codes on the labels of the label reel and to generate corresponding bar code data;

said controller comparing the bar code data from said bar code sensor with predetermined bar code data and, upon detection by said controller that the bar code data of one of the labels does not match the predetermined bar code data, said controller timely activating said container removal unit so as to remove one of the containers at said take-out end that was attached with said one of the labels whose bar code data does not match the predetermined bar code data;

a label sensor coupled electrically to said controller and disposed adjacent to the advancing route of the label reel between said reel support plate and said label applicator plate, said label sensor generating a first signal upon detection of a part of the backing paper strip having one of the labels adhered thereon, and further generating a second signal upon detection of another part of the backing paper strip having none of the labels adhered thereon;

wherein upon detection by said controller that the duration of the second signal from said label sensor has exceeded a predetermined threshold, indicating that a portion of the label reel has none of the labels adhered thereon, said controller timely activating said container removal unit so as to remove one of the containers at said take-out end that was not attached with any one of the labels;

a printing unit disposed adjacent to the advancing route of the label reel between said reel support plate and said label applicator plate, and adapted to print batch information on the labels of the label reel; and a batch information sensor coupled electrically to said controller, disposed adjacent to the advancing route of the label reel between said printing unit and said label applicator plate, and adapted to sense the batch information that was printed on the labels of the label reel and to generate corresponding batch information data;

said controller comparing the batch information data from said batch information sensor with predetermined batch information data and, upon detection by said controller that the batch information data of one of the labels does not match the predetermined batch information data, said controller timely activating said container removal unit so as to remove one of the containers at said take-out end that was attached with said one of the labels whose batch information data does not match the predetermined batch information data.

14. The labeling machine of claim 13, wherein said container removal unit includes:

a counter for generating a count output corresponding to each of the containers processed by said label applying unit; and a push unit operable so as to push said one of the containers for removal at said take-out end of said conveying unit.

15. The labeling machine of claim 14, wherein said push unit includes a push plate and a pressure cylinder for driving pushing operation of said push plate.

16. The labeling machine of claim 13, further comprising a container collector for collecting said one of the containers that was removed by said container removal unit at said take-out end of said conveying unit.

17. The labeling machine of claim 13, wherein each of said bar code sensor, said label sensor, and said batch information sensor are spaced apart from said label applicator plate at predetermined distances that are in units of length of the labels.

* * * * *